United States Patent [19]

Kesting

[11] Patent Number: 4,715,163

[45] Date of Patent: Dec. 29, 1987

[54] APPARATUS FOR MORTARING LARGE-FORMAT BRICKS INTO A WALL

[76] Inventor: Lorenz Kesting, Holzheck 21, 4600 Dortmund-Eving, Fed. Rep. of Germany

[21] Appl. No.: 737,740

[22] Filed: May 28, 1985

[30] Foreign Application Priority Data

Feb. 20, 1985 [DE] Fed. Rep. of Germany ..... 3505841

[51] Int. Cl.[4] ..... E04G 21/22

[52] U.S. Cl. ..... 52/749

[58] Field of Search ..... 52/749; 414/418, 419, 414/421, 423

[56] References Cited

U.S. PATENT DOCUMENTS

| | | | |
|---|---|---|---|
| 1,457,639 | 6/1923 | Straight | 414/623 |
| 1,606,001 | 11/1926 | Thomson | 52/749 |
| 2,192,691 | 3/1940 | Mutch . | |
| 2,519,282 | 8/1950 | Priester | 414/623 |
| 2,527,103 | 10/1950 | Noack | 414/623 |
| 2,624,608 | 1/1953 | Rowe | 414/623 |
| 2,718,426 | 9/1955 | Nagy | 414/623 |
| 3,177,621 | 4/1965 | Demarest | 52/749 |
| 3,438,171 | 4/1969 | Demarest | 52/749 |
| 3,503,174 | 3/1970 | Nichols | 52/749 |
| 4,060,955 | 12/1977 | Lachnit | 52/749 |

FOREIGN PATENT DOCUMENTS

| | | | |
|---|---|---|---|
| 812832 | 7/1951 | Fed. Rep. of Germany . | |
| 2444752 | 4/1976 | Fed. Rep. of Germany . | |
| 3146650 | 6/1983 | Fed. Rep. of Germany . | |
| 34180 | 2/1964 | Finland . | |
| 2260671 | 9/1975 | France . | |
| 2468700 | 5/1981 | France . | |
| 2520779 | 8/1983 | France . | |
| 287072 | 2/1965 | Netherlands | 52/749 |
| 157480 | 1/1963 | U.S.S.R. . | |

OTHER PUBLICATIONS

Tsckerkassow, Stone and Brickwork, Kiev, 1961, p. 196.

Sizow, Technology of Concrete and Reinforced Concrete Products, 1972, p. 353.

Muro, Ventilation System for . . . 1981, FIG. 6.

*Primary Examiner*—John E. Murtagh

*Attorney, Agent, or Firm*—Andrus, Sceales, Starke & Sawall

[57] ABSTRACT

A large-format artificial brick has vertical air channels extending therethrough. Recesses on the ends of the brick and on the top and bottom of the brick form additional air circulating channels for a heating or cooling medium. In a building formed with such large-formal bricks, a blower is located in the basement and connected to the vertical passages by a manifold. The bricks may be formed into a building by apparatus having a magazine for storing a stack of artificial bricks. A manipulator releases the bricks one at a time to form the building wall.

19 Claims, 20 Drawing Figures

Figure 1:
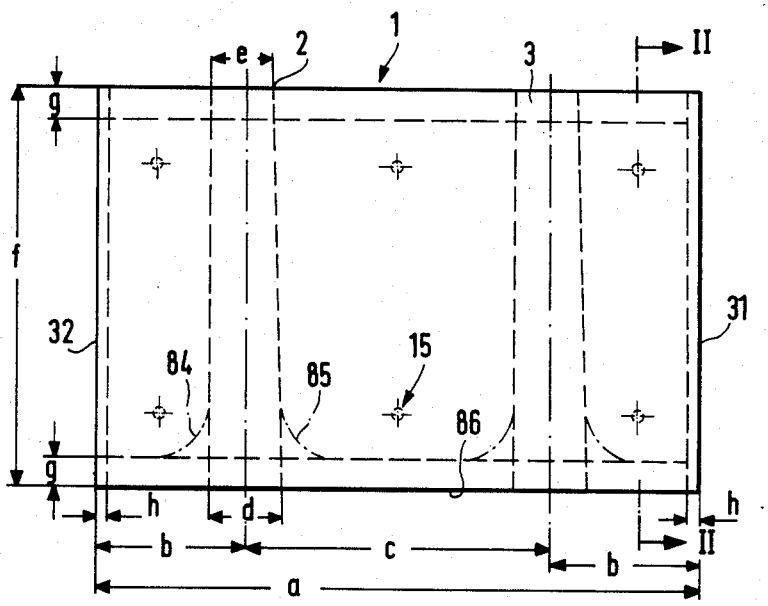

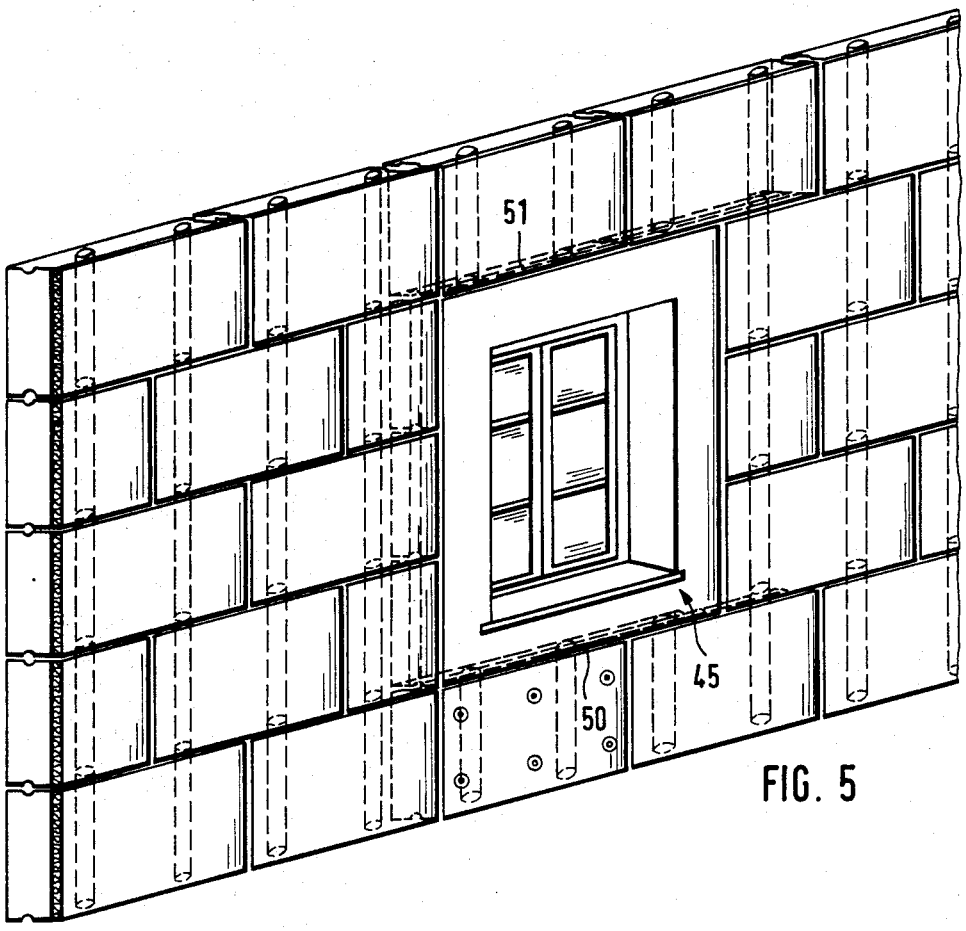
FIG. 5
FIG. 6
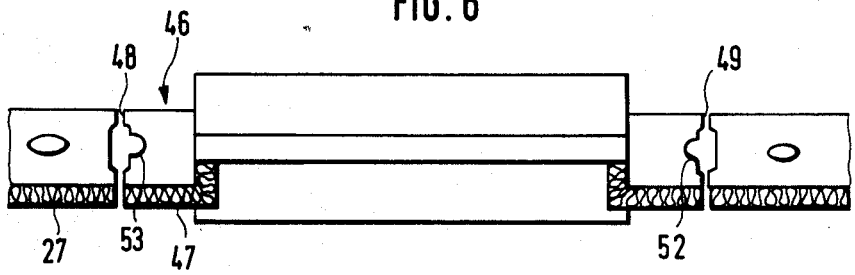

APPARATUS FOR MORTARING LARGE-FORMAT BRICKS INTO A WALL

The present invention relates to a prefabricated part for constructing a building air-conditioned via its walls, an apparatus for walling up such prefabricated parts and a building exhibiting walls constructed using such prefabricated parts.

The partial air-conditioning of a building, in particular a residential building, usually requires the building to be heatable in the winter if it is located in a climatic zone involving low outdoor temperatures, and to be capable of being at least cooled in climatic zones involving high outdoor temperatures. The full air-conditioning of a building requires heating and cooling as the seasons change. If the medium which is used to supply heat and possibly to eliminate heat is conducted not via radiators or cooling devices but through wall channels provided at least in the outer walls of the building, but possibly in its ceilings as well, this results in heat exchange surfaces as large as the walls or ceilings in the air-conditioned rooms of the building, thereby allowing for the possibility of achieving even temperature distribution in the rooms, on the one hand, and relatively small differences in the advance flow and return temperatures of the heating medium, on the other hand, which in turn allow for favorable efficiency factors of the air-conditioning and make it economical to use reverse cycle heating systems in some cases. In such air-conditioned buildings, wall designs which allow for a gaseous medium for transporting heat are in general considerably more favorable than buildings in which heat exchange pipes or tubes must be used to conduct a liquid heat transporting medium, which is in particular warm or hot water. This is based not least on the danger of leaks in the conduit system and the difficulties in eliminating the damage to the building caused thereby. High costs are also involved for installing pipes which are required by a liquid heat medium.

The heat transporting medium, which is therefore preferably gaseous, can be conducted in accordance with the invention in open circulation. However, since considerable heat losses may occur in this case due to the small difference between the inlet temperature and the outlet temperature of the medium, at least when the building is being heated, the invention relates in particular to the construction of walls in which a closed circulation of the medium takes place. It is not a system operated by natural pull which is involved here, in spite of the vertical arrangement of the wall channels and the horizontal channels, but rather forced circulation of the gaseous medium. Since, in accordance with the invention, the walls are heated and a good efficiency factor is to be achieved at the same time, the outer walls of the building are generally insulated in order to prevent heat from flowing outside to the greatest possible degree.

The erection of a building designed according to such considerations using prefabricated parts reduces the work to be done at the construction site to the absolute minimum and allows for certain subassemblies to be produced in an industrialized fashion, which is ultimately less expensive. If these subassemblies are one-storey-high wall elements or even an uninterrupted outer skin, there are a number of disadvantages as compared with masonry consisting of artificial bricks which must be erected on the construction site. For instance, the reinforcement of the wall elements as required in large panel construction but which is superfluous in the case of brickwork not only increases costs, but also adds even more to the considerable weight of the wall elements, which are already difficult to transport and install. Brickwork also prevents a number of sealing difficulties which frequently cannot be avoided in large panel construction from arising at all. The relatively high labor costs for qualified craftsmen and costs for the material required for the masoning can be considerably reduced in the case of the masonry consisting of standard bricks, as was the only customary kind formerly, by using large-format artificial bricks which nevertheless do not require reinforcement. Different dimensions are used here, but large-format artificial bricks made of chalky sandstone, clay brick, pumice stone and concrete are quite customary, the height of the bricks used ranging, for example, from 23.8 cm to 50.3 cm and the length from 2.4 m to 4.2 m.

The invention assumes a known air-conditioned building (German Offenlegungsschrift No. 23 46 906). The outer walls and/or the inner walls of this building are penetrated by the vertical channels extending from the basement up to the roof for the gaseous medium to flow through, the flow of the medium being regulatable using restrictors. However, it is extremely difficult to erect such a building. Furthermore, the design of vertical channels in the walls has turned out to be alone no guarantee of the desired even temperature distribution over the walls. The known building therefore does not meet either the requirement of even heat distribution, which is necessary in terms of the comfort of the air-conditioning, or that of a favorable efficiency factor of the air-conditioning, which is crucial as far as the economy of such a building is concerned.

The invention provides a prefabricated part for constructing the walls of a building of the type assumed as being known, which part reduces the work to be performed at the construction site without giving rise to the difficulties involved in large panel construction, thereby increasing the economy of construction in this manner and also achieving a degree of uniformity of the wall temperatures which ensures the necessary comfort in the rooms and allows for a favorable efficiency factor of the air-conditioning.

The favorable results of masoning using large-format artificial bricks are utilized in accordance with the invention to erect the building, whereby the large-format artificial bricks, being designed to have a plurality of recesses each forming a section of adjacent vertical wall channels, allow at the same time, according to the invention, for the distance between the vertical heating channels to be reduced to such an extent as to result in an even temperature distribution in the bricks and over the wall. Further, the even temperature distribution over the entire wall of the building is further improved, if desired, by using the large format of the artificial bricks to form horizontal connecting channels by aid of the semitubular depressions in the brick surfaces limiting the horizontal brickwork joints, into which the vertical wall channels open out. The resulting temperature balance in the vertical flow of the medium due to the transverse flow in the wall bricked up in this manner ultimately leads to the desired even temperature distribution over the wall being achieved via the brick and joint surfaces.

The invention does not jeopardize the economy of masoned walls already achieved using large-format artificial bricks but further increases it. For at the construction site the channels can be kept free of joint mortar without any great difficulty due to the large format of the bricks, and be already used to conduct a heating medium while the building is being erected. This allows for winter construction, whereby the finished vertical or horizontal channels in the partially erected walls are subjected to hot-air blowers. For it is easy to connect pipes or tubes to the available openings of the channels and remove them again.

The economy during the erection of the building can be further increased substantially by an embodiment in which the outer insulation of the walls conducting the medium, which is crucial for the economy of the air-conditioning, is already completed to a large extent during its industrialized production so that only little work remains to be done at the construction site. An even further-reaching degree of rationalization of the work at the construction site is provided by the embodiment that allows for expedient attachment of the thermal insulation to the artificial brick, the means of attachment may also be used at the construction site for attaching a warm or cold facade.

The best results have proved to be attained with the invention when it is possible in this case to create a distance between the vertical heating channels which is even across the entire width of the wall in spite of the vertical joints. This is extremely favorable for achieving an even wall temperature.

It is of course expedient to give the wall channels a design which is as smooth as possible in order to reduce the flow resistance in the walls of the building which the medium flows through. This is only possible in general, due to the large format of the inventive artificial bricks, if at least the larger recesses, i.e. the recesses for the wall channels, are kept open on the inside using mandrels. The embodiment that considerably facilitates the extraction of the mandrels out of the mass of the large-format brick is expedient.

The features of the artificial bricks create more favorable conditions for conducting the gaeous heating medium in the finished brickwork above a horizontal joint in each case using the recesses having funnel-shaped extensions for the vertical wall channels.

It is also recommended to provide the vertical joint sides of the inventive artificial bricks with uninterrupted depressions. This produces joggling of the bricks with the joint mortar filling in the vertical joints, thereby considerably increasing the stability of the brickwork.

The features of the artificial bricks also facilitate mechanized walling up, in particular the walling up of the above-described inventive prefabricated parts.

The invention also relates to an apparatus for walling up large-format artifical bricks. It mechanizes the erection of brickwork, in particular the laying of the artificial bricks on the masoned horizontal joints, and is therefore used, generally speaking, for artificial bricks which can no longer be handled by masons due to their dimensions and their weight.

The inventive apparatus serves in particular for walling up artificial bricks which have up to four uninterrupted vertical channels and recessed edges, whereby the recesses in the horizontal brick edges may form uninterrupted horizontal channels in a horizontal joint of the brickwork in the recesses of adjacent artificial bricks.

The crane-supported grab which is part of the inventive apparatus preferably grasps the bricks in the arrangement in which they have been delivered and deposited at the construction site by a prefabricated part factory. The bricks therefore do not in general have to be arranged and grouped at the construction site in accordance with their relative positions in the subsequent brickwork, so that there is no more need for the labor involved in such a task or for the apparatus required to mechanize it.

The grab grasps several bricks of simple design and deposits them simultaneously on the horizontal joint of the brickwork, which has already been mortared. The apparatus preferably cooperates with a framework which serves as a template for keeping to the height and width of the joint. This framework constitutes formwork for the horizontal joint on the joint length predetermined by the number of bricks grasped by the grab and is used for filling in the mortar on which the bricks are deposited.

The erection of brickwork requires, however, that each brick be placed and oriented separately and that half-bricks can also be walled up using the grab when the process is fully mechanized. This is virtually impossible using the known apparatus because, when it is used rationally, it always grasps and deposits several bricks of a horizontal joint at a time. Therefore, the bricks to be walled up at the same time must be grouped together and oriented horizontally beforehand on the construction site in such a way that the bricks can be simultaneously grasped by the grab and raised by the crane, maintaining intervals between the bricks corresponding to the vertical joints.

The rationalization effect is therefore relatively small.

The invention provides an apparatus of this type which allows for a considerable advance in terms of rationalization.

This problem is solved by the invention having the features the claims.

Due to the fact that stacks of several artificial bricks arranged one on top of the other are magazined in the inventive apparatus, only one brick at a time is deposited on a horizontal joint, which corresponds to the way an expert mason goes to work but is mechanized. Using the manipulators, the invention makes it possible for the new apparatus to place all bricks grasped in a magazined stack on mortared horizontal joints singly and successively, without being swung back to the construction site. This takes place in a tandem system which shifts the bricks in the apparatus downward in layers and releases whichever brick is in the lowest layer but holds onto the following brick until the magazine is empty. In the case of the heaviest bricks up to now, the inventive apparatus can preferably take up in its magazine three-layer stacks having three bricks accordingly. On the other hand, the tandem system makes it possible to take up whichever bricks are required in a particular case from the delivered stacks and stack them into the magazine. This eliminates the efforts required up to now for simultaneously grasping a plurality of selected bricks.

An even further-reaching degree of rationalization in erecting the described brickwork can be achieved preferably by the use of one or more mortar containers. This is done by mortaring the horizontal and possibly the vertical joints using a quantity of joint mortar determined by the joint itself and the number of grasped bricks with the aid of the inventive apparatus having the the mortar containers. Since the required quantity of mortar is carried along on the scaffold of the inventive apparatus, the correct quantity of mortar required at any time is available so that the crane does not need to be made use of specially for this purpose nor must the quantity of mortar be measured off and distributed onto the joints, which is difficult when mortar pumps are used and also frequently soils the construction site.

The sections separable by slides allow for the quantity of mortar required to wall up each individual brick to be available in the proper dose and be provided on or in the particular horizontal or vertical joint in accordance with the way an expert mason goes to work. This considerably facilitates and accelerates the walling up of the bricks, whereby the quality of the brickwork corresponds exactly to the requirements.

The closed inclined discharge of the mortar container allows for wide joints to be mortared in the proper manner. The distribution of the joint mortar is limited to a small number of operations. When the vertical joint is being made, the joint mortar need only be poured into the joint space until the latter has filled up from the bottom to the top. When the horizontal joint is being mortared, the inventive apparatus provides the joint mortar immediately above the lower steep surface.

It is expedient to make the mortar discharge adjustable in the grab because after the joint mortar has been provided the apparatus required therefor can be swivelled out of the clearance gauge of the magazine, thereby making room for the brick to be deposited on the freshly mortared joint.

A further possibility of providing the joint mortar above the lower boundary of the horizontal mortar joint in a rational fashion is opened up by the use of a mortar container arranged about the stack of bricks in the grab, in particular in the case of the artificial bricks used for air-conditioning purposes and having the features described at the outset. The mortar container may be housed in a fixed position in the crane-supported scaffold but an elevator device dependent on the number of vertical brick recesses used at the same time must be provided for the cleaning bodies so that the brick recesses used for the mortar discharge can be freed again after mortaring.

The apparatus is provided with manipulators which allow for the heavy bricks to be grasped in the described tandem system in a form-fitting fashion, thereby guaranteeing safety at the construction site.

The tongs make it possible, using this apparatus, for the mortaring to be supported with its formwork from the outside when the lowest brick is deposited, thereby avoiding deformation of the joint as a result of the weight of the brick.

The other features of the claims characterize a group of embodiments of the inventive apparatus, which has a compact design and, furthermore, houses the parts of the manipulators in the recesses in the bricks, thus utilizing them to rationalize the walling up process.

The details, further features and other advantages of the inventive prefabricated parts and of a building walled up of such prefabricated parts can be found in the following description of embodiments of the invention with reference to the figures in the drawing.

These show:

FIG. 1 a front view of a prefabricated part according to the invention

Figure 2:
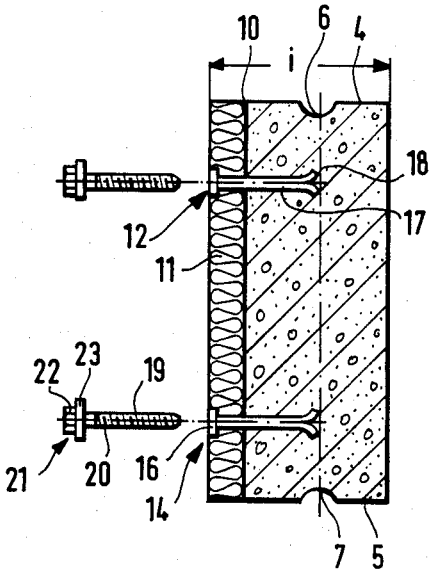

FIG. 2 a side view of the object of FIG. 1 in cross-section II—II

Figure 3:
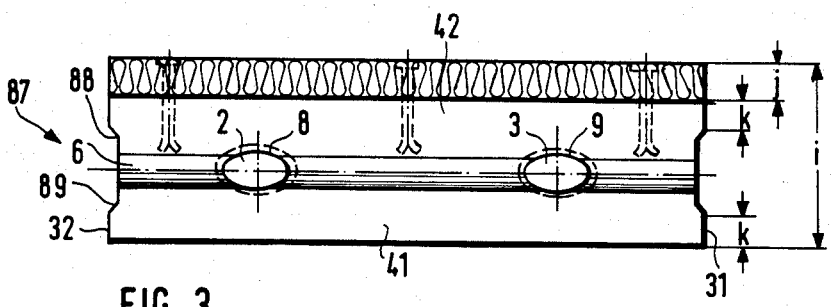

FIG. 3 a top view of the object shown in FIGS. 1 and

Figure 4:
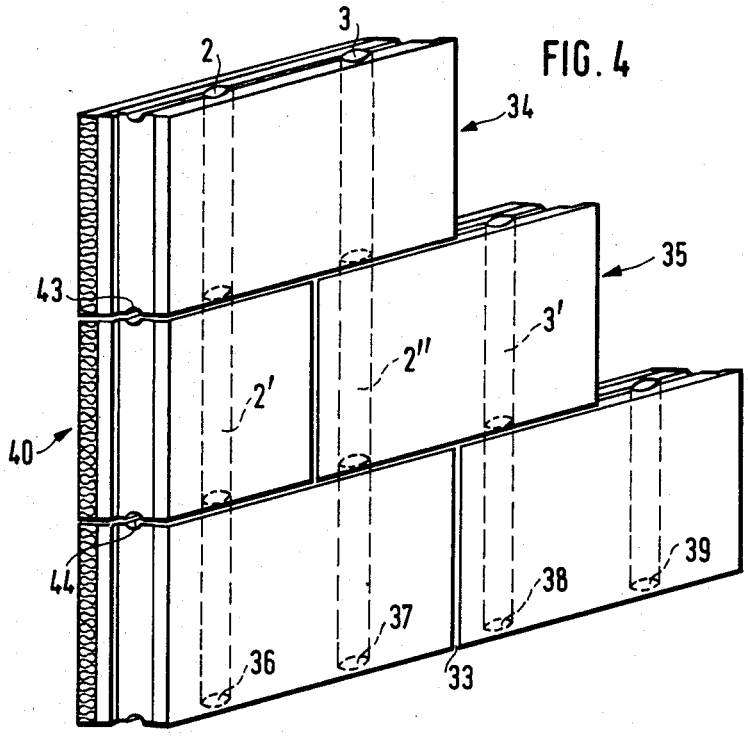

FIG. 4 a perspective view of a wall bond made using the prefabricated parts according to FIGS. 1 to 3

FIG. 5 a view corresponding to FIG. 4 of part of a wall of a building erected using such prefabricated parts FIG. 6 a top view of the part of the outer wall provided with the window according to FIG. 5

Figure 7:
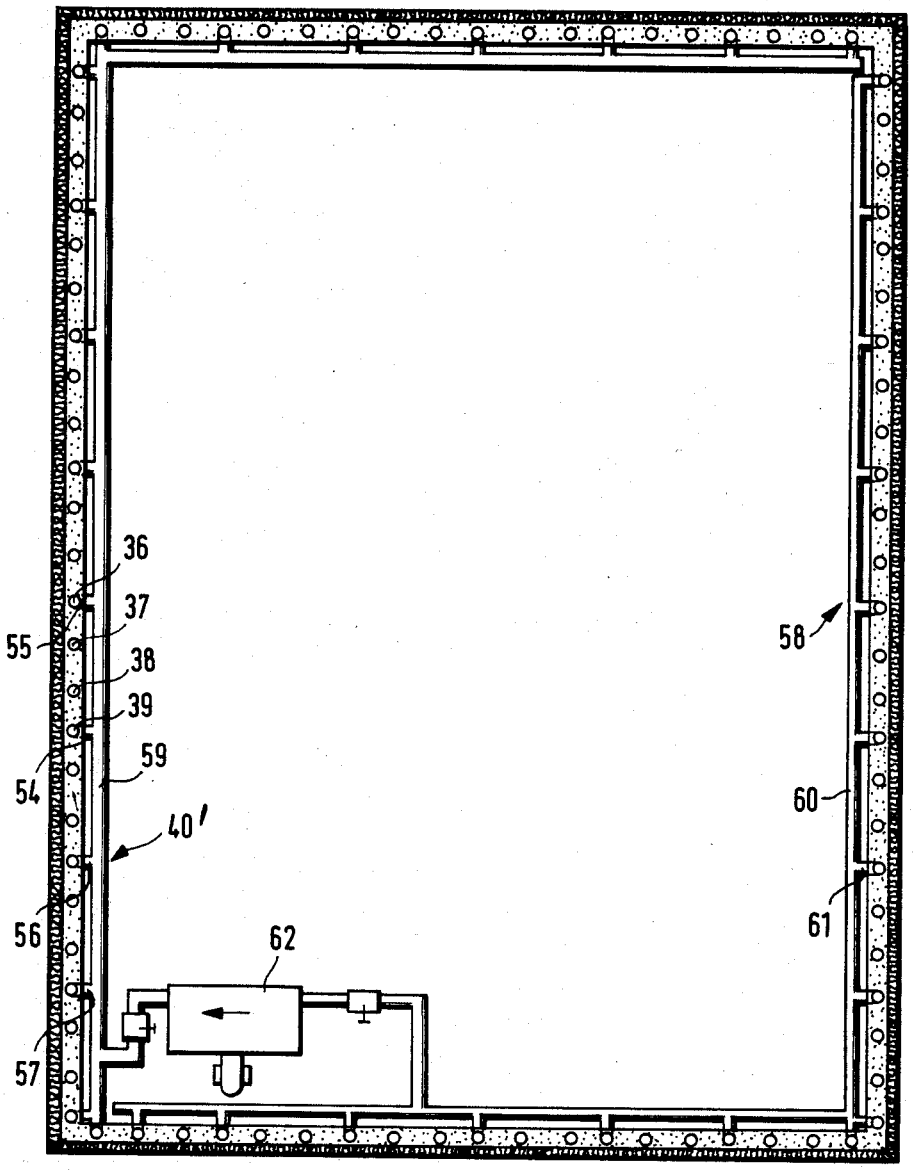
Figure 8:
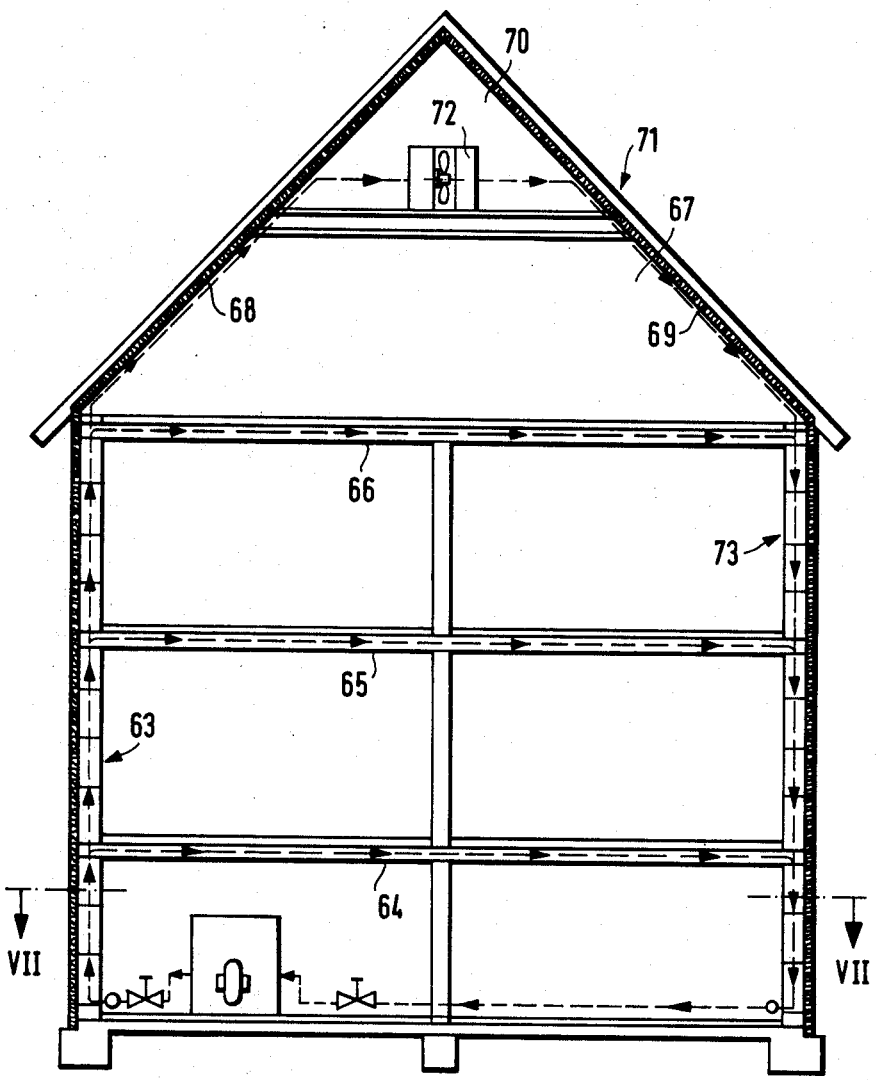
Figure 9:
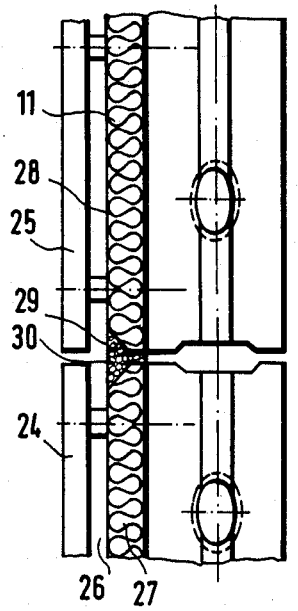
Figure 10:
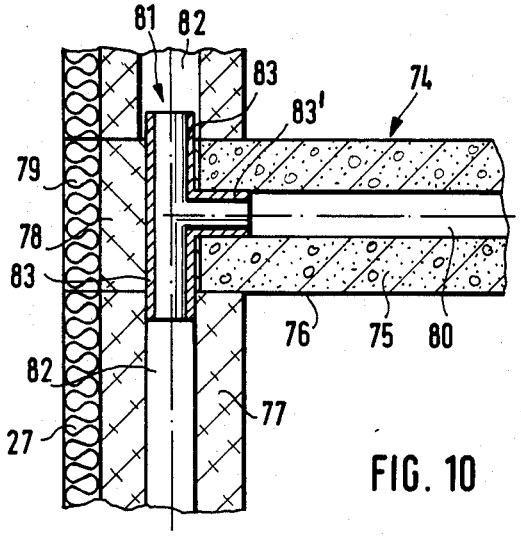
Figure 11:
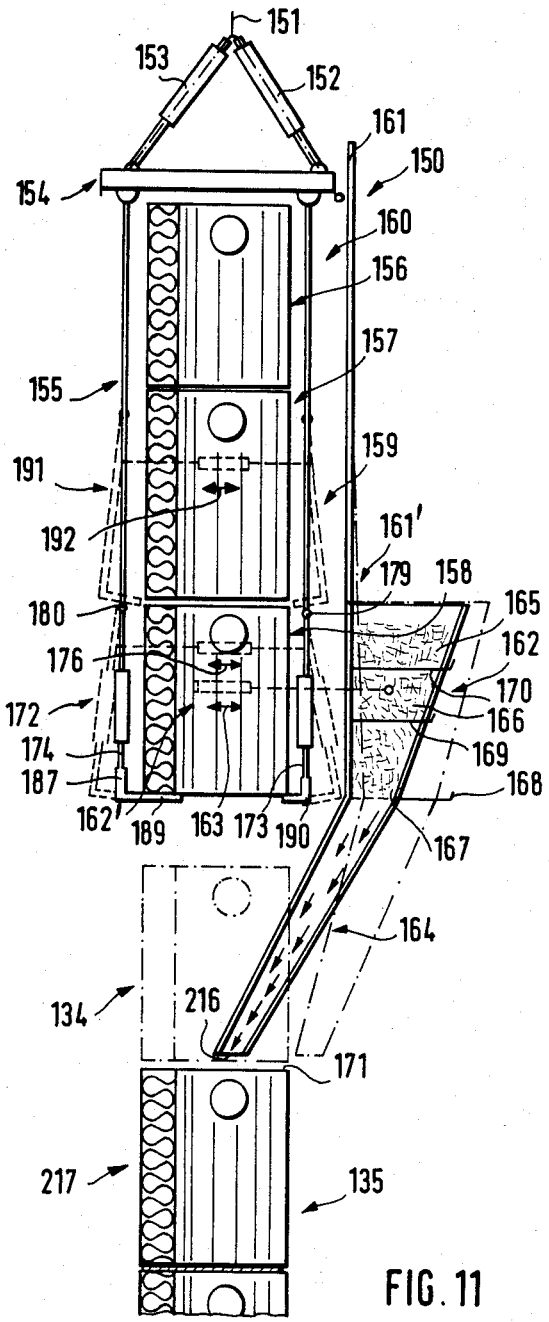
Figure 12:
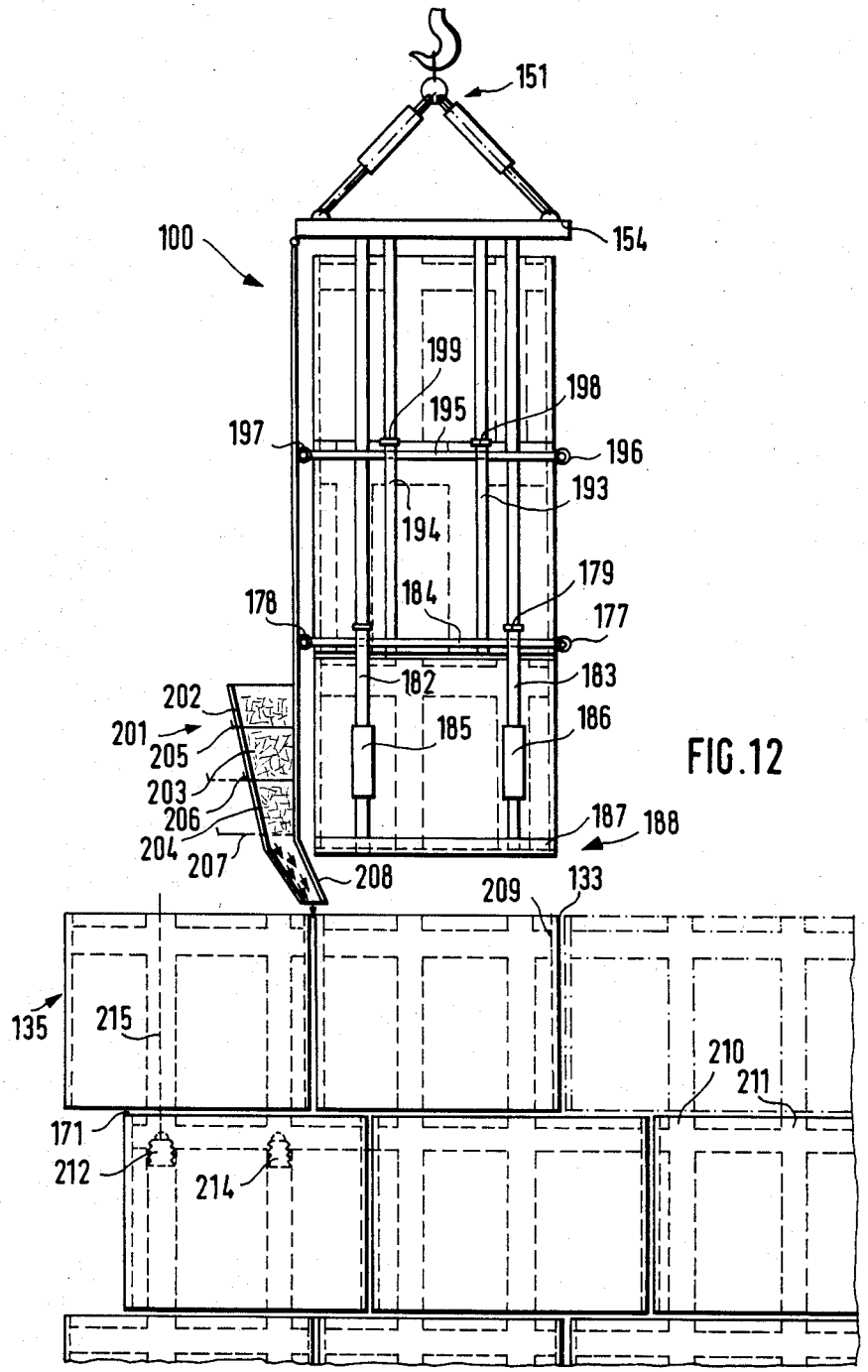
Figure 13:
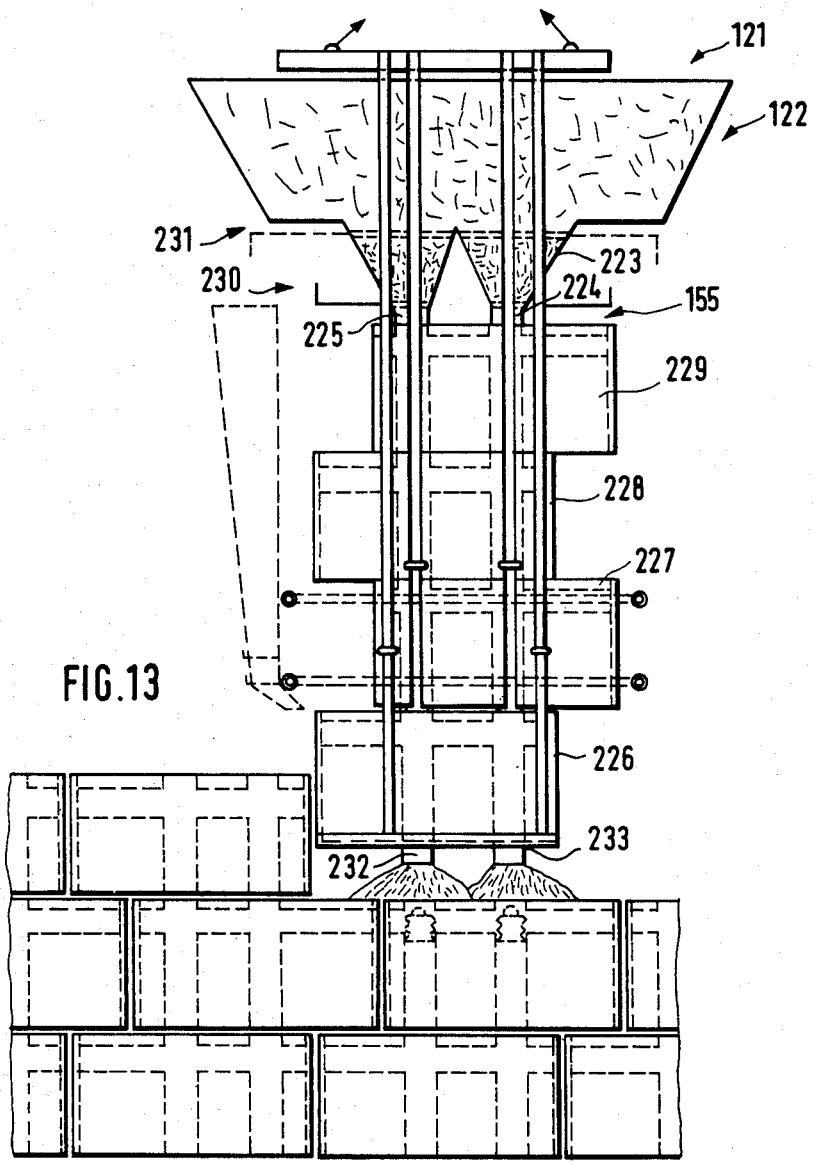
Figure 14:
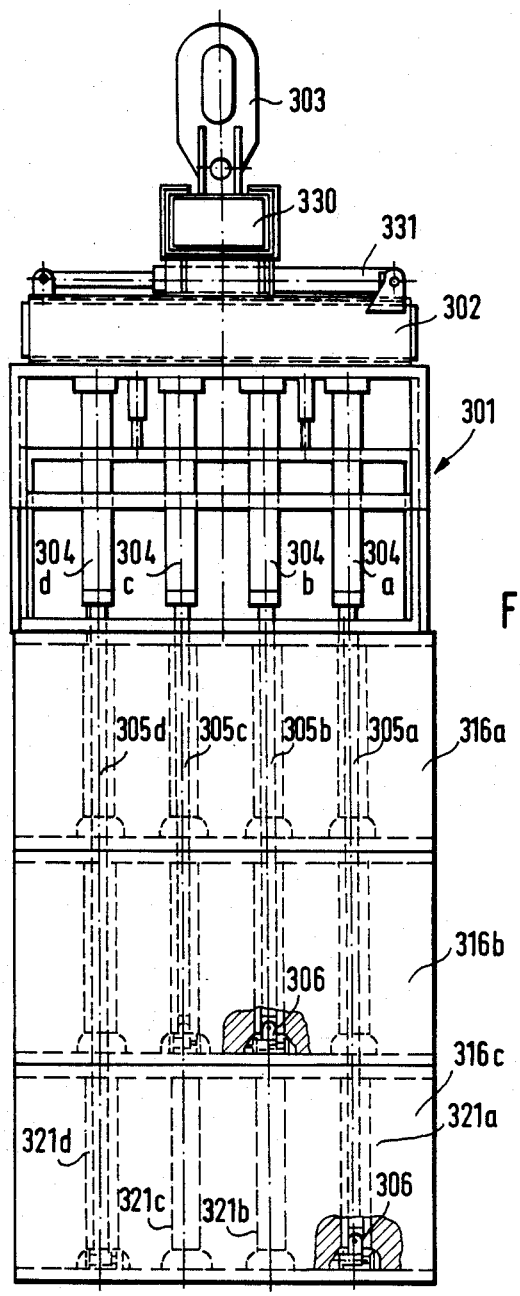
Figure 15:
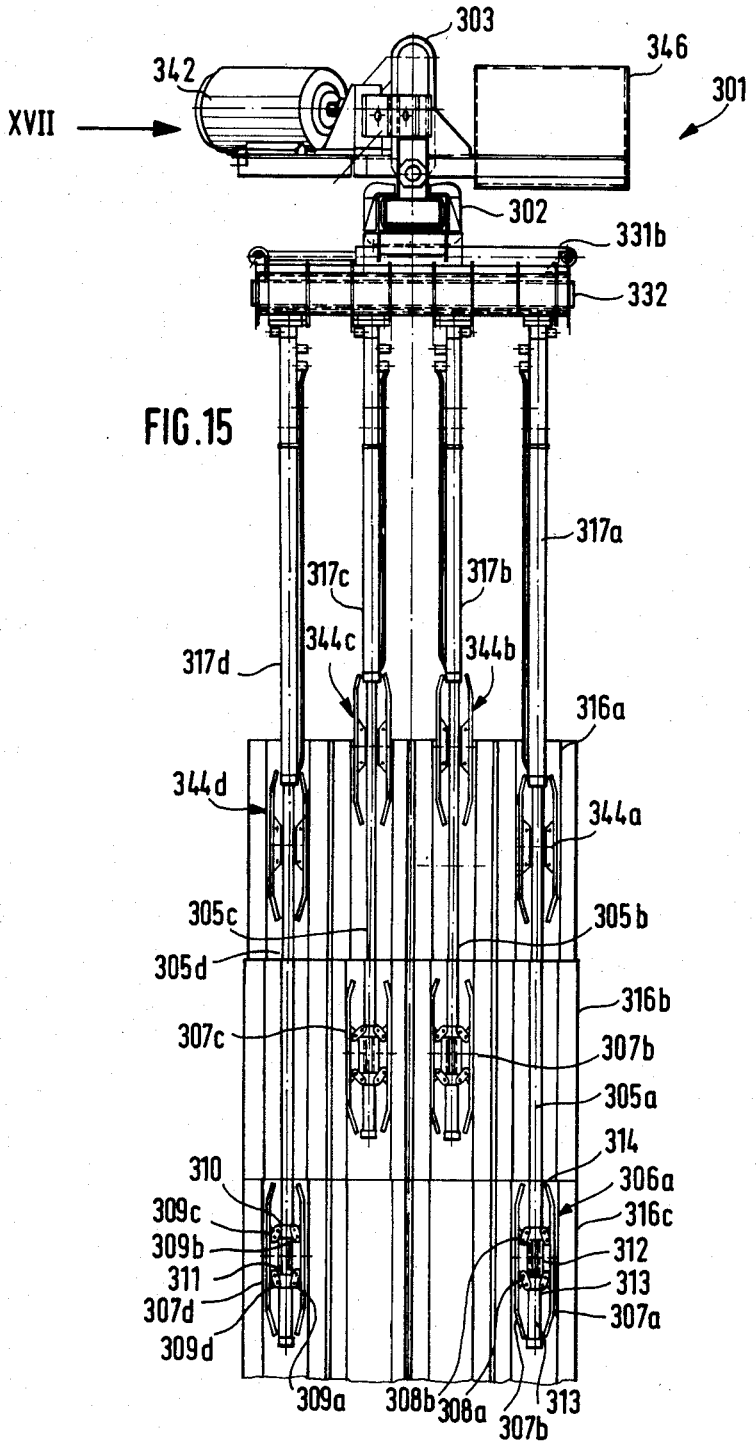

FIG. 7 a schematic view of the air-conditioning system provided in the basement of the building and in its attic FIG. 8 a schematic view of a building according to the invention in order to illustrate the circulation of the medium FIG. 9 a detail of the wall design along one of the joints of the brickwork FIG. 10 part of a transverse beam with the adjacent ceiling in a building according to the invention, the parts being shown in a vertical section FIG. 11 a first embodiment of the invention during the construction of a building wall of walled-up large-format artificial bricks which are shown from the front FIG. 12 the apparatus according to FIG. 11 seen from the side, assuming a different design of the artificial bricks FIG. 13 a view corresponding to FIG. 12 of a modified embodiment of the inventive apparatus FIG. 14 an apparatus according to the invention in a further embodiment in a view corresponding to FIGS. 12 and 13, omitting the brickwork FIG. 15 a modified embodiment of the inventive apparatus in a view corresponding to FIG. 14

Figure 16:
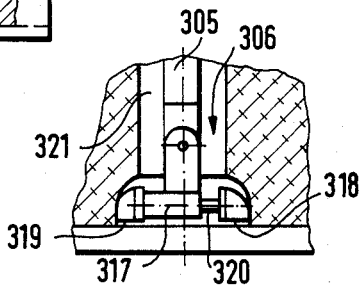

FIG. 16 a brace according to the invention, which is preferably used in an apparatus of the type shown in FIG. 14

Figure 17:
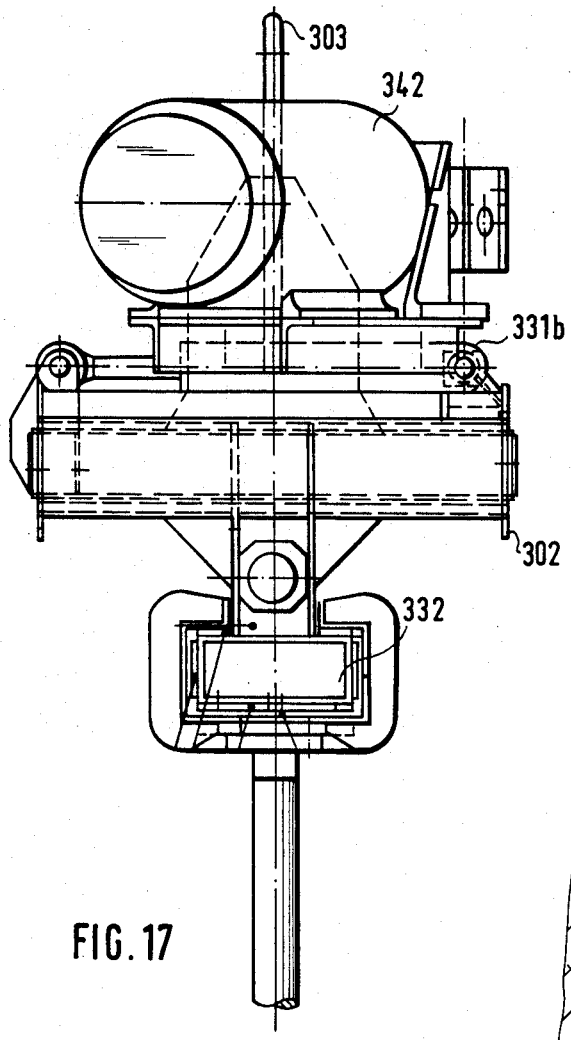
Figure 18:
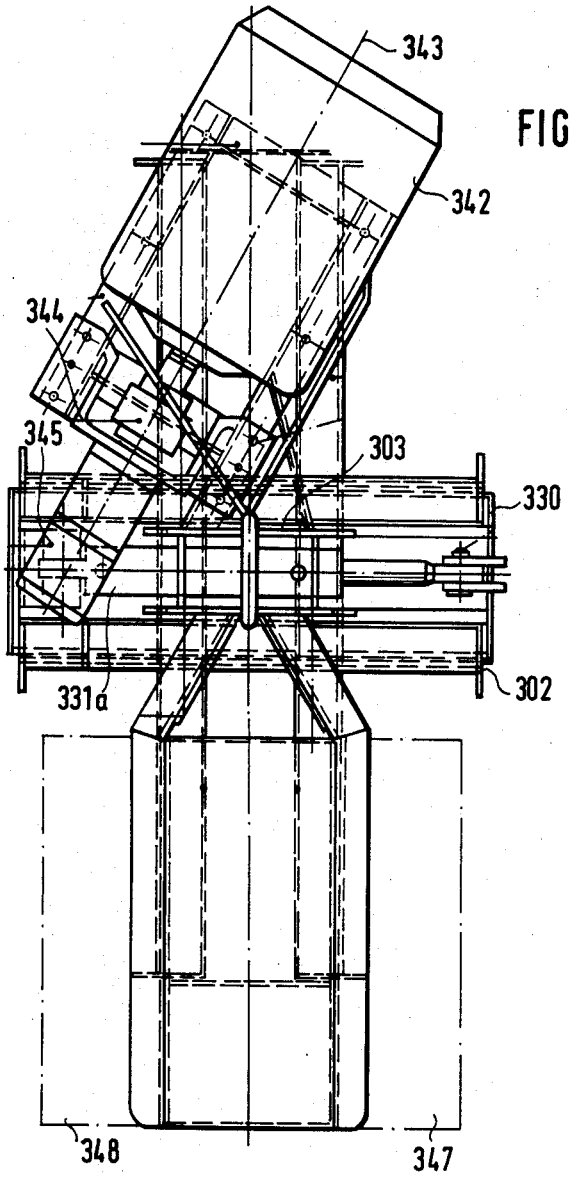

FIG. 17 a broken-off partial view of the apparatus according to FIG. 15 in the direction of arrow VII FIG. 18 a top view of the object of FIG. 15

Figure 19:
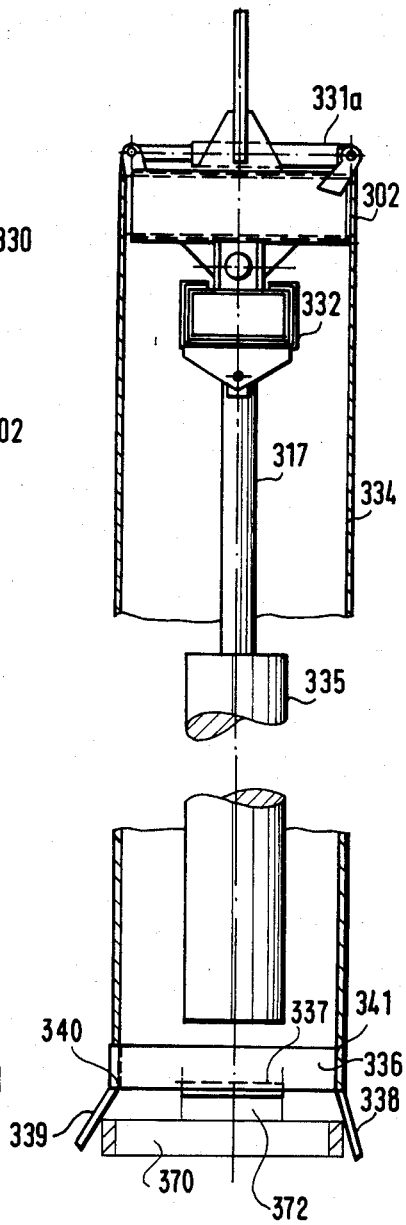

FIG. 19 a further modified embodiment of the invention, substantially in the form according to FIG. 14 in a view corresponding to FIG. 11

Figure 20:
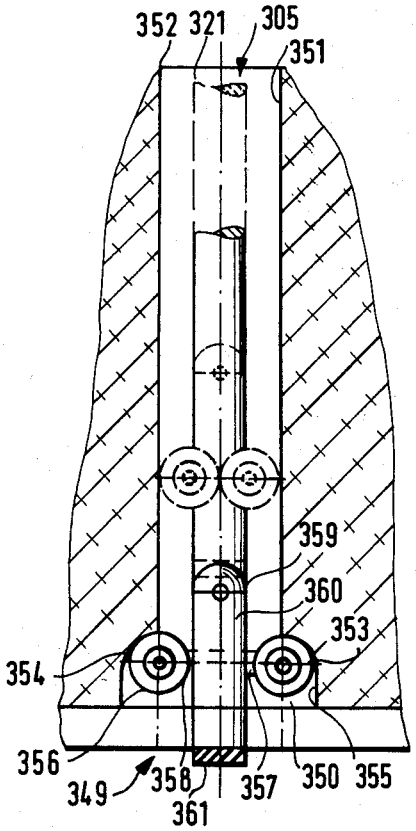

FIG. 20 a brace modified with respect to the embodiment of FIG. 16 but preferably used instead thereof The prefabricated part shown in the drawings is formed by a large-format artificial brick 1. This brick has two recesses 2, 3 (FIG. 3) each forming a section of adjacent vertical wall channels,and a semitubular depression 6, 7 (FIG. 2) formed in each brick surface 4, 5 limiting the horizontal brickwork joints. These depressions are semicircular grooves so that a substantially circular cross-section is formed when the brickwork is constructed of two adjacent bricks. As can be seen in FIG. 3, this semitubular depression 6, 7 shows openings 8, 9 of recesses 2, 3, as shown by the example of semitubular depression 6.

To elucidate the format of the artificial brick according to the embodiment of FIGS. 1 to 3 of the invention, the following dimensions are stated by way of example:

a=1.0 m
b=24.75 cm
c=50.5 cm
d=12 cm
e=10 cm
f=64 cm
g=5 cm
h=1.5 cm
i=30 cm
j=6 cm
k=5 cm

The above-stated dimensions serve only as an example, of course. However, they state the average brick format which thus differs substantially from the so-called standard brick having edge lengths of 6.5×12×25 cm and whose dimensions are in the relation of 1:2:4.

On the side of the brick assigned to the subsequent facade side of the building (FIGS. 2 and 3), this side of the brick being referred to as 10 in FIG. 2, artificial brick 1 bears a thermally insulating plate which may be made of Styrofoam, for example, and is referred to as 11. As can be seen in FIG. 2, this plate is attached by aid of anchors 12, 14 which are distributed in accordance with the hole pattern indicated in FIG. 1 and identified by arrow 15. These anchors have flat heads 16, one anchor shaft 17 each and spread ends 18. Such an artificial brick may be made, for example, out of a mixture such as concrete. For this purpose, a shell mold is used, which is not shown but which shapes the narrow sides of the brick with its four walls. The thermally insulating plate 11 provided with anchors 12, 14 is inserted into the bottom of such a mold, flat anchor heads 16 being oriented toward the bottom of the mold. The mixture is then poured in and hardens around the shaft and end 17, 18 of each anchor.

Shaft 17 has a hollow design according to the embodiment of FIG. 2. It serves as a spreading sheath for a threaded 19 shaft 20 of a bolt 21 with a hexagon head 22 and washer 23. A number of bolts 21 corresponding to the number of anchors 12, 14 is used according to the view of FIG. 9 to provide individual elements 24, 25 of a cold facade. This term commonly refers to a facade having an air gap 26 between the outside of the thermal insulation referred to in general as 27. Facade elements 24, 25 are cooled from behind by this convectional current and can therefore not be warped by exposure to sunlight. However, the design of a cold facade with elements 24, 25 designed as in FIG. 9 is not a necessary condition for realizing the invention. Warm facades can also be realized in which the facade elements lie immediately against the thermal insulation.

As can further be seen in the view of FIG. 9, the outer edges of thermally insulating plates 11 are canted off, as can be seen schematically at 28. This results in filling seams 30 at the joints of the brickwork, as shown at 29. The thermal insulation of the wall can be limited to the production of these filling seams 30 at the construction site. This is preferably done using a liquid thermosetting synthetic material.

If dimensions a to c stated at the outset are compared, this results in a certain arrangement of the two recesses 2, 3 for the vertical wall channels in artificial bricks 1. That is, each of recesses 2, 3 is spaced away from the vertical joint side 31 or 32 (FIG. 1) adjacent thereto by approximately half its distance c away from the other recess, and the mutual distance c between recesses 2, 3 corresponds to the sum of their distances d away from vertical joint sides 31, 32 plus the joint width. The width of these vertical joints, one of which is referred to as 33 in FIG. 4, may be relatively small. In the embodiment shown, it is 1 cm and thus allows, in the heading bond shown in FIG. 4, for automatic alignment of recesses 2, 3 of the respective upper layer 34 with the recesses shown at 2' or 2'' of the binder layer 35 located therebelow. This pattern also holds, of course, for recesses 3', which are aligned with recesses 2 of upper layer 34. In this manner, vertical wall channels 36 to 39 come about as in FIG. 4 when the heading bond, referred to in general as 40, is constructed. It can be reliably ruled out that joint mortar penetrates into the openings of recesses 2, 3 when the brickwork is being constructed because the distribution of the joint mortar can be limited to brick surfaces 41, 42 (FIG. 3) without making any particularly high demands on the skill of the mason. In horizontal joints 33 (FIG. 4) the subsequent connecting channels may be kept open in the joint mortar by tubes inserted into the horizontal connecting channels 43, 44 and subsequently removed. However, such tubes are not absolutely necessary. Contrivances may also be used to keep openings 8, 9 of vertical recesses 2, 3 open when the horizontal joints are being masoned, these contrivances possibly consisting of small steel plates which are pulled out after the binder layers have been constructed and before the joint mortar has completely hardened. The. vertical joints otherwise do not contain any channels which must be kept open, with the exception of the connecting channels crossing them, whereby these crossings may be kept open in the same manner as the other channels.

The brickwork can be carried out in winter construction because hot air can be introduced into the openings of horizontal wall channels 43, 44 from a blower set up on the construction site, serving to heat the joints until the mortar has hardened.

As can also be seen in the view of FIG. 1, recesses 2, 3 have a conical design on one side, which is favorable for removing a form keeping these recesses open from the hardened brick.

At 84 and 85 in FIG. 1 the funnel-shaped extensions of an embodiment of the invention which are assigned to the lower joint side 86 are shown. In this embodiment the design of recesses 2, 3 serves the purpose of improving the flow through the horizontal wall channels into the vertical wall channels.

The view in FIG. 3 also indicates identical depressions 87 in the vertical joint sides, these depressions being groove-shaped. These grooves have a flat base area 88 and walls which point obliquely outward, one of which is referred to as 89. This causes the brickwork to be clamped at right angles to the wall when the vertical joints are subsequently filled in completely, insofar as these joints extend across the vertical joint surfaces 31, 32 of the bricks.

As shown in the view of FIG. 5, heat or cold bridges are avoided in the area of windows 45—and, if desired, in the area of doors. For this purpose, a soffit frame 46 which is also prefabricated of concrete or a different artificial stone is used (FIG. 6). This soffit frame bears on its facade surfaces a thermally insulating layer 47 which continues thermally insulating layer 27 of the outer front as far as the window soffit. Outer edges 48, 49 and 50, 51 (FIG. 5) located in the brickwork are provided with grooves 52, 53 forming vertical flow channels which are subjected to the heating medium via the horizontal channels which open thereinto. Corresponding grooves are formed in the horizontal sides of the frame members so that the entire soffit frame participates in heating the wall.

The view of FIG. 7 constitutes a cross-section along line VII—VII of FIG. 8. One can see the plurality of vertical flow channels for the gaseous heating medium arranged one close beside the other and indicated by reference numbers 36 to 39. The flow channels shown are adjacent vertical wall channels in which the heating circuit distribution is indicated. Heating circuit distributor 40' serves the purpose of supplying the heated heating medium, but only acts upon every third wall channel via a transverse bore 54, 55 and a connecting branch 56, 57 of distributor pipe 59 opening into said bore. This possibility of connecting only a fraction of the vertical wall channels at their lower end to heating circuit distributor 40' can be further exploited because horizontal wall channels 43, 44 ensure even distribution of the heating medium and thus the conveyance of the medium into the vertical wall channels not connected directly to the heating circuit distributor.

According to the view in FIGS. 7 and 8, the building is provided with an advance flow system which is fed via heating circuit distributor 40', and also has a return system fed via heating circuit distributor 58, thereby giving rise to a circulation of the medium. Heating circuit distributor 58 consists, like heating circuit distributor 40, of a main pipe 60 with outlets consisting of connecting branches 61 arranged at predetermined intervals, horizontal wall channels 43, 44 again ensuring the distribution of the returning medium into the vertical wall channels not connected to distributor 59. Aggregate 62 serves the purpose of heating the medium in the case of partial air-conditioning in climatic zones with low outdoor temperatures, this medium usually being air. It may also have a cooling aggregate at the same time, so that the house can be cooled in the summertime. The medium flows upward in advance flow conduit 63 (FIG. 8) through the vertical wall channels of the advance flow system, thereby partially crossing ceilings 64 to 66 of the building. Insofar as the flow regulated by fixed or adjustable restrictors reaches the attic, oblique walls 68, 69 present in the attic 67 completed for habitation are also acted upon by the heating medium in the manner which has already been described for the vertical walls. However, the roof will generally be lined with hollow boards which are appropriately insulated on the outside.

In the ridge area 70 of gable roof 71, which is not completed for habitation, there is a blower 72 which ensures forced circulation of the heating medium into the downwardly directed return system 73.

The connection of the hollow ceilings to the vertical and horizontal wall channels which is accordingly necessary can be seen in the view of FIG. 10. A hollow ceiling plate 74 made of reinforced concrete 75 in precast construction is used. This plate lies with its outer edge 76 on the binder layer of the brickwork shown at 77 and limits the conventional transverse beam 78 toward the inside, which in turn is provided with an insulating layer 79 which continues the outside insulation 27 of the brickwork. The parallel horizontal ceiling channels are connected singly, as can be seen by the example of horizontal ceiling channel 80 shown in FIG. 10, to the vertical wall channel shown in FIG. 10 and referred to as 82 therein by aid of T-shaped connecting pipes 81. These T-pieces 81 are located with both ends of their through pipes 83 in the mutually aligned recesses of the bricks forming the brick layer, and with their blind pipes 83' in the end of the horizontal ceiling channel involved.

The described restrictors for regulating the medium flow are expediently constructed in the lower branch of the vertical wall channel involved.

According to the embodiment shown in FIGS. 11 and 12, an apparatus referred to in general as 150 is used for making the wall bond 40 shown in FIG. 4 (although using a modified embodiment of the inventive large-format bricks lacking the arrangement of vertical channels 2, 3). This apparatus involves a scaffold 154 supported by a crane (not shown) via a crane cable 151, that is, suspended thereon by a plurality of shock absorbers 152, 153. In this scaffold, the details of which are rendered only insofar as they are necessary for understanding the invention, there is a shaft 155 which serves as a magazine for a plurality of artificial bricks of the described type, arranged one above the other and referred to as 156 to 158 in FIG. 11. A manipulation or grab generally referred to as 159 cooperates with this shaft. On one of the broad sides of shaft 155, which is referred to as 160, a mortar container 162 is suspended via a linkage of bars 161 so as to swivel around a hinge arranged at 161' by aid of a hydraulic working cylinder 162' in the direction of double arrow 163. Mortar container 162 can be swivelled into the operating position shown by unbroken lines, in which it protrudeswith its discharge 164 partly into the clearance gauge of the shaft, and out of this position into the position shown by dot-dash lines, in which the clearance gauge of the shaft is free. Mortar container 162 exhibits a number of sections 165 to 167 separated by slides which corresponds to the number of artificial bricks 156 magazined in the shaft. Stop slide valves 168 to 170 assigned to sections 165 to 167 block off the soace in the section in question at the bottom, said space being coordinated with a quantity of mortar corresponding to the length of one horizontal joint 171 (FIG. 12) which is limited to a longitudinal side 5 of brick 1 (FIG. 1).

FIG. 11 also indicates details of the embodiment shown of grab 159. Its main portion consists of a lower pair of tongs 172 whose arms 173, 174 can be shifted in the direction of double arrow 176 by aid of a hydraulic working cylinder 177, 178 (FIG. 12) in each case out of the closed position of the tongs shown by solid lines into the open position, which is shown in dotted lines, and vice versa. The joints 179, 180 of the tongs are provided on each side of magazine 155 in scaffold 154.

As FIG. 12 indicates by the example of tong joint 179, each arm of the tongs is formed by two parallel levers 182, 183, which are synchronously moved by working cylinders 178, 179 by aid of a common tie-bar 184. A shock absorber 185, 186 is built into each lever. The ends of the levers are attached to a lath 187 which, together with the adjacent lath of the opposite arm of the tongs, forms a template 188 as formwork for the described horizontal joint 171. Laths 187 are part of a brick grab 189, 190 which grasps the sides of brick 1 from below. Due to insulating plate 11, grab 189 is longer than grab 190 and the swivelling paths of the tong arms vary in accordance with the grab length.

The second manipulator according to the embodiment of FIG. 11 exhibits a further pair of tongs 191 corresponding to the pair of tongs 172, this pair of tongs 191 having a similar design to pair of tongs 172 and being opened and closed in accordance with double arrow 192, which is shown in the same manner as for pair of tongs 172 in FIG. 11.

For this purpose, each arm of tongs 191 is again constructed of parallel levers 193, 194, which are swivelled by aid of a common tie-bar 195 by working cylinders 196, 197 in their hinges 198, 199.

On the front side 200 of scaffold 154 a mortar container 201 with three sections 202 to 204 and slides 205 to 207 closing off these sections is suspended. Discharge 208 of mortar container 201 is arranged in such a way that it does not protrude into the clearance gauge of magazine 155. Otherwise, mortar container 201 is also suspended in scaffold 154 so as to swivel, as described with reference to mortar container 162.

Since a virtually automatic mode of operation is provided in the example of FIGS. 11 and 12, precautionary measures are taken to keep recesses 209 in the vertical joints 33 and recesses 210, 211 in the horizontal joints 171 free. Inflatable tubes introduced into horizontal recesses 6 of adjacent bricks and later removed serve to keep recesses 209 free, while cleaning bodies 212, 214 of the known type, which are drawn by aid of traction mechanisms 215 into the bricks of a horizontal brick layer 35 after this layer has been laid and the joint mortar has hardened in joint 171 are used to keep recesses 210, 211 free according to the embodiment shown.

The apparatus shown in FIGS. 11 and 12 operates as follows.

First, the apparatus is deposited on the construction site by aid of the crane and loaded with the three large-format prefabricated parts 156 to 158 shown. Pairs of tongs 172 and 191 of grab 159 have been closed in the necessary order. What is also done beside the brickwork and with the scaffold 154 in a deposited state is the filling of its mortar containers 162, 202 with a quantity of mortar in each case which corresponds to the overall quantity of that required for the three bricks 156 to 158, the mortar for the horizontal joints 171 being provided in mortar container 162. When the mortar containers are being filled the slides are open. After filling they are closed.

After the bricks 156 to 158 have been magazined and mortar containers 162, 202 have been filled, the crane raises the scaffold 154 to that point of the wall which is to be constructed further. Scaffold 154 is first stopped above joint 171 to be mortared (FIG. 11) so that mortar container 162, which is in its operating position, points with opening 216 of its mortar discharge 164 approximately to the middle of mortar joint 171. The worker employed at the wall itself now first pulls slide 168, whereby this process may of course also be mechanized by aid of the working cylinder. This releases the quantity of mortar contained in section 167 so that it slides through closed discharge 164 onto joint 171. As soon as the mortar has run out completely, mortar container 162 is swivelled into the position shown in FIG. 11 by dot-dash lines.

The scaffold 154 is thereafter lowered by aid of the crane until laths 187 of grab 188 described in connection with FIG. 12 lie against the flanks of the brick shown at 217 of installed layer 135 of the brickwork. Scaffold 154 is thus centered on the installed portion of the brickwork. Pair of tongs 172 is then opened. Since pair of tongs 191 remains closed, only the lower brick 158 comes out of shaft 155 onto the mortar of joint 171 when the tong arms have opened. The formwork on the joint prevents the mortar from emerging out of the joint toward the outside when it spreads under the pressure of brick 158 when it is laid. The template lath assigned to manipulator 189 at the same time prevents the joint mortar from coming onto the front side of insulating plate 11.

In order to make it easier to keep to the joint height, the large-format brick exhibits four identical cams 118, 119 and 120 altogether on the lower side limiting the brick. These cams form a constructional unit with brick 1 and are dimensioned such that they can break when they have fulfilled their purpose. This purpose consists in being supported by the joint mortar which is still soft on upper side 4 of the bricks of horizontal brickwork layer 135 when it has been installed, thereby limiting the joint height.

As soon as lower large-format brick 158 has been laid on the mortar bed of joint 171, slide 207 of section 104 in mortar container 201 is drawn, thereby causing the mortar contained in this section to gointo vertical joint 209 through discharge 208. Since the quantity of mortar is measured off, joint 209 is filled and the flow of mortar automatically stopped by discharge 208 as soon as joint 133 is filled.

Apparatus 150 can then wall up a second brick, i.e. brick 157 which is kept ready in shaft 155. For this purpose, pair of tongs 172 is closed and pair of tongs 191 opened. This causes the two bricks 156, 157 arranged one on top of the other to slide downward in magazine 155 until brick 157 comes to rest on brick grabs 189, 190 as brick 158 did before. Shock absorbers 185, 186 described ensure during this process that the apparatus is not subjected to an dangerous dynamic stress.

After apparatus 150 has been prepared in this manner for walling up brick 157, it works in a manner analogous to that described for the walling up of brick 158.

The embodiment of apparatus 221 as in FIG. 13 corresponds in all parts to apparatus 150 with the following exception: above shaft 155 mortar container 222, which corresponds to mortar container 162, is installed in a fixed position. Accordingly, the container takes up the same quantity of mortar as container 162 but has a discharge 223 formed by a forked pipe which constitutes the connection via corresponding connecting branches 224, 225 to vertical recesses 2, 3 of the four large-format bricks 226 to 229 stacked in shaft 155 as shown in the embodiment of FIG. 13. The shaft is open on its narrow sides so that the bricks can be arranged one on top of the other in accordance with the arrangement in the binder brickwork.

Instead of divisioning off each quantity of mortar for a joint 171 using separate slides, the forked portion of pipe 223 is divisioned off using two pairs of slides 230, 231 which are mutually activated, thereby measuring off the required quantity of mortar. Since pipes 224, 225 protrude through the mutually aligned recesses 2, 3 of threaded large-format bricks 226 to 229, they form a guideway for bricks 226 to 229 and can better distribute the joint mortar with their ends 232, 233 protruding out of whichever brick 226 is located at the bottom.

The mode of operation of the apparatus corresponds to that already described in connection with the embodiment of FIGS. 11 and 12.

FIG. 14 shows an apparatus for manipulating bricks stacked one on top of the other, which is referred to as 301. A transverse girder **302*a* is suspended by aid of a ring 303 on the hook (not shown) of a crane. A longitudinal girder 330 is displaceably mounted opposite ring 303 by aid of a working cylinder 331*a***.

A girder 332 is displaceably mounted with a cylinder **331*b* on the underside of girder 330 facing away from ring 303. Four pressure medium cylinders 304*a* . . . 304*d* are attached parallel one beside to the other to this girder 332. Pressure medium cylinders 304*a* . . . 304*d* exhibit piston rods 305*a* . . . 305*d*. Spreading elements 306 are arranged in the lower area of the piston rods in each case as in FIG. 15**.

FIG. 15 shows each of spreading elements **306*a* . . . 306*d* which are identical to each other and consist of two rocker-shaped plates 307*a*, 307*b* located opposite each other. These plates form a knee toward the inside at each end. The plates are provided on their insides facing the particular piston rod 305***a* . . . 305*d* on trapezoid brackets 308*a*, 308*b* to which two connecting rods 309*a* . . . 309*d* are pivoted in each case. Connecting rods 309 are pivoted at their other ends to two collars 310 and 311 which enclose piston rods 305 spaced apart from each other vertically. The ends of a helical spring 312 are supported on the two collars 310 and 311. Collar 310 is displaceable on the piston rod in the longitudinal direction thereof against the pressure of helical spring 312. Collar 311 is supported downwardly on a shoulder 313 of the piston rod and thereby fixed, while the displacing movement of collar 310 is limited upwardly by a stop 314. This stop 314 forms the lower edge of a piece of pipe capable of being slid in the manner of a telescope over piston rod 305, this piece of pipe pressing against collar 3 10 when subjected to pressure, thereby compressing the helical spring. When the distance between collars 310 and 311 is shortened in this manner, connecting rods 309 are drawn up out of their original position, thereby moving plates 307 outwardly from piston rod 305. The outer sides of the plates are padded and come to lie against the walls of the recesses provided in the prefabricated parts 316*a*, 316 *c* to be manipulated. After release of pressure the plates are restored to their original position by aid of the bent helical spring 312.

An alternative embodiment of spreading element 306 is shown in FIGS. 14 and 16. Spreading element 306 consists here of a pressure medium cylinder 317*a* . . . 317*d* arranged at the lower end of piston rods 305*a* . . . 305*d* at right angles to the longitudinal axis of the piston rod. Pressure medium cylinder 317 protrudes beyond the case of the piston rod both with its end 318 on the piston rod side and with its opposite end 319. Both end 318 and end 319 of pressure medium cylinder 317 are provided with rubber cushions. When subjected to the pressure medium, piston rod 320 of pressure medium cylinder 317 moves out, pressing the rubber cushions against the walls of the recesses in brick 316. According to FIG. 16 recesses 321 are broadened locally for spreading elements 306 in order to give the brick more support by form closure when spreading element 306 is spread out.

Brick 316 used according to the invention is provided in the embodiment with recesses 321 having a rectangular cross-section, the corners of this rectangular being rounded. The upper portion of recesses 321 has a funnelshaped extension. This funnel-shaped extension makes it easier to introduce spreading elements 316 arranged on the piston rods.

The mode of operation of the apparatus described and shown in FIGS. 15 to 20 is as follows. Three bricks 316*a* . . . 316*c* stacked one on top of the other are oriented such that their recesses 321*a* . . . 321*d* located parallel beside each other are flush with the corresponding recesses in the adjacent bricks. Using a crane which is not shown, the apparatus is suspended via ring 303, with piston rods 305*a* . . . 305*d* run in, above the stack which was erected beforehand out of bricks 316*a* . . . 316*c*. The lower ends of piston rods 305*a* . . . 305*d* are each located with spreading elements 306 attached thereto precisely above broadened portion 322 of recess 321. The piston rods are then moved out and the spreading elements lowered into recesses 321. Piston rods 305*a* and 305*d* of outer pressure medium cylinders 304*a* and 304*d* are moved out as far as recess 321 of lowest brick 316*c*, while spreading elements 306*b* and 306*c*, which are assigned to the two inner pressure medium cylinders 304*b* and 304*c*, are moved out into second brick 316*b*. Spreading elements 306 then come to lie against the walls of recesses 321. When lowest brick 316*c* is to be deposited, spreading elements 306 of outer cylinders 304*a* and 304*d* move back into their original positions, releasing the brick. The remaining bricks are held on the apparatus by spreading elements 306*b* and 306*c*, which are assigned to the two inner cylinders 304*b* and 304*c*. Piston rods 305*a* and 305*d* of the two outer cylinders 304*a* and 304*d* are moved in until spreading elements 306 are located in recesses 321 of uppermost brick 316*a*. Here, spreading elements 306 are activated again. The following brick 316*b* can then be lowered.

According to the view of FIG. 15, after stack 335 consisting of prefabricated parts 316*a* . . . 316*c* has been taken up as described (FIG. 19'), said stack being already formed when delivered from a factory for prefabricated parts, balance is provided via hydraulic cylinders 333*a*, 333*b* of apparatus 301 by a controlling means (not shown), whose regulating variable is the inclination of stack 335 of the elevated apparatus with respect to the vertical, until the stack is suspended vertically. Only then is the stack swivelled by the crane above the brick joint already completed.

Apparatus 301 is provided in the embodiment of FIG. 19 with a rigid rectangular pipe 334 which is attached to girder 302 with its upper end. Pipe 334 surrounds cylinder 317 and elevated stack 335. At the free end of pipe 334 tie-bars 336 are attached which have downwardly protruding, strong electromagnets 337 and downwardly and outwardly diverging baffle plates 338 and 339 which ar provided in parallel frame tie-bars 340 and 341. Electromagnets 337 cooperate with a frame 370 which corresponds to frame 336 and is placed on the joint in question. Iron cores 372 which cooperate with electromagnets 337 are attached to tie-bars of this frame. Before stack 335 is placed on the joint, electromagnets 337 are excited; after a prefabricated part from stack 335 has been deposited in the manner described above, they are switched off. In this manner it is possible to orient apparatus 301 precisely with respect to the joint using excited electromagnets 337 before a prefabricated part from stack 335 is released and deposited.

In the embodiment shown in FIGS. 15, 17, 18 and 20, ring 303 bears an electrical pressure generator for the pressure oil which is required to activate the various working cylinders described above. The parts of the pressure generator are arranged such that apparatus 301 is adjustable in ring 303, using various cylinders 331*a* and 331*b* to such an extent that stack 335 is suspended vertically. Thus, electromotor 342 is arranged with its axis 343 at an acute angle to the axis of girder 332. The motor shaft is directly coupled to a hydraulic pump 345 via a coupling 344. A pressure tank 346 is constructed on the other side of ring 303 (FIG. 15). The electrical system provided in a switch cabinet is shown schematically at 347 (FIG. 18) and the various remote-controllable electrovalves for switching the cylinders are shown schematically at 348 (FIG. 18).

According to the embodiment of the invention as in FIG. 20, which is modified with respect to FIG. 16, the spreading elements at the ends of piston rods 305 shown in FIG. 16 and described above are each replaced by a brace 349 which makes it easier to find the locally broadened area 350 of recess 321 due to the fact that its effective parts are outwardly biased in a resilient manner so that these parts move on rolling contact on inner surface areas 351, 352 of recess 321 when piston rods 305 move downward or upward as shown by dotted lines in FIG. 20. Alternatively, the effective parts of the braces are driven outward by the effect of the spring bias so that they lie against the inner surfaces 353, 354 of broadened areas 350. However, this possibility of outwardly directed movement is limited to a measure which makes it easier to introduce the braces into the conical initial ends of recesses 321, which are not shown in FIG. 20.

In the embodiment of FIG. 20, the braces consist of rollers or pairs of rollers 355, 356 whose bearings are mounted on rams 357, 358 which are in turn biased by one or more spiral springs (not shown) on both sides into the body 360 of the brace suspended around a transverse axis in pendulum fashion at the end of the piston rod. The rollers are equipped with rubber tires. Body 360 bears on its underside a rubber cushion 361 which is driven downward onto the horizontal joint by the piston rod 305 in question when the piston rod moves out. Rubber cushion 361 therefore forms an abutment which fixes the position in which rollers 355, 356 mesh with broadened areas 350. As soon as this happens, the prefabricated part in question is blocked with the brace in a formfitting manner.

Cables or chains may be used instead of the hydraulic cylinders 304 with their piston rods 305 shown in the embodiments and described above. Parallel winding bodies may thus be provided on girder 302 to take up the cables or chains which replace cylinders **304*a*, 304*d* and 304*b*, 304*c*. The winding bodies are driven by hydraulic motors and extend parallel to the longitudinal axis of girde 302** and/or to each other.

I claim:

1. An apparatus for mortaring large format bricks into a wall, said apparatus including:

a frame suitable for being lifting above the wall;

a magazine (155) mounted on said frame for receiving a vertical stack of at least two bricks (156-158);

lower and upper manipulator means (172, 191, 306, 317) in said magazine for releaseably engaging the lowest brick of said stack within said magazine and the next lowest brick of said stack within said magazine, respectively, for retaining the bricks against vertical movement in the magazine when so engaged; and operating mean for said lower and upper manipulator means for cyclically operating said manipulator means to cause said lower manipoulator means to engage said lowest brick in said stack, to cause said lower manipulator means to release said lowest brick to vertically, downwardly discharge said lowest brick from the bottom of the magazine onto said wall while said upper manipulator means engages said next lowest brick, to cause said upper manipulator means to release said next lowest brick to obtain downward movement of said next lowest brick in said magazine to become the lowest brick in said magazine, and to thereafter cause said lower manipulator means to engage the lowest brick to retain the lowest brick in said magazine.

2. The apparatus according to claim 1 further including at least one mortar container (162, 201) on said frame for receiving and discharging mortar for the joints between the bricks in the wall.

3. The apparatus according to claim 2 wherein said mortar container is sized to receive a quantity of mortar coordinated with the number of bricks in said magazine.

4. The apparatus according to claim 3 wherein said mortar container is divided into a plurality of sections, (165-167; 202-204) separable by slides, the capacity of said sections corresponding to the quantity of mortar required for the joints of one brick and the number of sections corresponding to the number of bricks that can be received in said magazine.

5. The apparatus according to claim 2 wherein at least one of said mortar containers (201) has a closed inclined discharge (208) the opening of which is positionable over a joint (209) formed at the ends of the bricks.

6. The apparatus according to claim 1 wherein at least one of said mortar containers (162) is movably mounted on said frame of applying mortar to horizontal joints in the wall.

7. The apparatus according to claim 1 further defined as one for mortaring bricks having vertical channels for conducting a gaseous medium for air conditioning or heating the wall, said apparatus further including a mortar container (22) mounted on said frame above said stack of bricks containing mortar for mortaring the horizontal joints in said wall, said mortar container having a discharge aligned with the vertical channels in said bricks for supplying mortar to said horizontal joints, said apparatus further including cleaning means (212, 214) for cleaning the vertical channels in said artificial bricks.

8. The apparatus according to claim 1 wherein said manipulator means compromise pairs of tongs (172, 191) for engaging said lowest and next lowest bricks (156-158) to support same from below, said tongs having arms (173, 174; 193, 194) for engaging the inner and outer surfaces of the bricks.

9. The apparatus according to claim 8 wherein the tongs of said manipulator means engaging the lowest brick of the stack has a lath means (187) orienting the brick to the stack and forming a formwork for the mortar joint at the bottom of said brick when deposited on said wall.

10. The apparatus according to claim 1 further defined as one for mortaring bricks having vertical channels for conducting a gaseous medium for air conditioning or heating the wall, and wherein said manipulator means includes means insertable in said vertical channels for releasably engaging said bricks.

11. The apparatus according to claim 10 wherein each of said means insertable in said vertical channels is further defined as including at least a pair of radially expandable heads for engaging said bricks.

12. The apparatus according to claim 11 wherein said manipulator means includes fluid pressure motor means for radially expanding said heads.

13. The apparatus according to claim 11 further defined in that said manipulator means includes a rod extendable into said vertical channels and on which said heads are mounted, each of said heads including toggle mechanisms (307) hinged to a pair of spaced collars (310, 311) on said rod, and a helical spring surrounding said rod between said collars, said lower collar being fixed on said upper collar being axially displaceable on said rod for radially expanding said head.

14. The apparatus according to claim 11 wherein each of said heads includes a pair of rollers (353, 354), said rollers beng radially displaceable with respect to a body (357) hinged on said insertable means, said insertable means bearing a cushion (351) serving as a stop in a horizontal joint in the brickwork of the wall.

15. The apparatus according to claim 11 wherein said insertable means is further defined as flexible.

16. The apparatus according to claim 11 wherein said insertable means includes a plurality of cylinders (317) capable of being operated by a pressure medium and having piston rods (305) insertable in said vertical channels.

17. The apparatus according to claim 10 wherein said insertable means is suspended from a first tie bar (332), said first tie bar being displaceably mounted on a first transverse girder (302), said first transverse girder (302) and a second tie bar (330) being displaceable on a second transverse girder (302*a*) fixed on said frame, said apparatus including first motor means for displacing said second tie bar (330) along said second transverse girder (302*a*), second motor means (331*b*) displacing said second tie bar (330*a*) with respect to said second transverse girder (302*a*), control means for activating said motor means and for detecting deviations of the stack from the vertical when said frame is suspended.

18. The apparatus according to claim 1 further including permanent magnets (337) on said frame, said magnets cooperating with iron cores (372) provided on portions of a joint frame (370) capable of being placed on a joint in the wall.

19. The apparatus according to claim 1 wherein said magazine is further defined as having baffle plates (338, 339) at its ends for orienting said bricks with the wall.

* * * * *